US008776286B1

(12) United States Patent
Edgerton

(10) Patent No.: US 8,776,286 B1
(45) Date of Patent: Jul. 15, 2014

(54) SIDE RAIL SELECTABLY MOVABLE FROM A FIRST UP POSITION OVER CENTER TO A SECOND DOWN POSITION

(75) Inventor: John Edgerton, Omro, WI (US)

(73) Assignee: GF Health Products, Inc., Atlanta, GA (US)

( * ) Notice: Subject to any disclaimer, the term of this patent is extended or adjusted under 35 U.S.C. 154(b) by 0 days.

(21) Appl. No.: 13/616,946

(22) Filed: Sep. 14, 2012

Related U.S. Application Data

(60) Provisional application No. 61/535,806, filed on Sep. 16, 2011.

(51) Int. Cl.
*A47C 21/08* (2006.01)

(52) U.S. Cl.
USPC ..... 5/430; 5/424

(58) Field of Classification Search
USPC ..... 5/425–430, 662
See application file for complete search history.

(56) References Cited

U.S. PATENT DOCUMENTS

| | | | | |
|---|---|---|---|---|
| 3,585,659 | A | 6/1971 | Burst et al. | |
| 3,865,434 | A * | 2/1975 | Sully | 297/411.33 |
| 4,747,171 | A * | 5/1988 | Einsele et al. | 5/425 |
| 4,993,089 | A * | 2/1991 | Solomon et al. | 5/430 |
| 5,381,571 | A * | 1/1995 | Gabhart | 5/430 |
| 6,389,622 | B1 | 5/2002 | Her et al. | |
| 7,107,637 | B2 * | 9/2006 | Kuek et al. | 5/430 |
| 7,257,850 | B1 * | 8/2007 | Tekulve | 5/430 |
| 7,591,034 | B2 | 9/2009 | Kramer et al. | |
| 2005/0229311 | A1 * | 10/2005 | Brooke et al. | 5/618 |
| 2006/0085912 | A1 * | 4/2006 | Kuek et al. | 5/430 |
| 2006/0117481 | A1 * | 6/2006 | Stryker et al. | 5/430 |
| 2010/0031441 | A1 * | 2/2010 | Guguin et al. | 5/430 |
| 2010/0031442 | A1 * | 2/2010 | Guguin et al. | 5/430 |
| 2010/0199428 | A1 * | 8/2010 | Guguin et al. | 5/430 |
| 2011/0258779 | A1 * | 10/2011 | Derenne et al. | 5/600 |

* cited by examiner

*Primary Examiner* — William Kelleher
*Assistant Examiner* — Richard G Davis
(74) *Attorney, Agent, or Firm* — Brannen Law Office, LLC

(57) ABSTRACT

According to one embodiment of the present invention, a side rail is provided having a body selectably movable from a first up position to a second down position. Two parallel lever arms are also provided. The arms rotate over center when moving the body between the two positions. This increases the horizontal distance through which the side rail moves. A biasing mechanism can be provided to urge the side rail towards either the up or down position, and to bias away from an intermediate toggle position wherein the lever arms are vertical in a preferred embodiment. The biasing mechanism can include a cam and roller. A hard stop can be provided, whereby in the up position there is a strong component to prevent failure. A release lever is also provided. A person can actuate the release lever to move the side rail from the up position.

19 Claims, 6 Drawing Sheets

SIDE RAIL SELECTABLY MOVABLE FROM A FIRST UP POSITION OVER CENTER TO A SECOND DOWN POSITION

This United States utility patent application claims priority on and the benefit of provisional application 61/535,806 filed Sep. 16, 2011, the entire contents of which are hereby incorporated herein by reference.

BACKGROUND OF THE INVENTION

1. Field of the Invention

The present invention relates to a side rail that is selectably movable from a first up position over center to a second down position.

2. Description of the Related Art

Bed side rails have existed for many years. In a basic form, a side rail is permanently fixed to the side of a bed frame. The side rail acts to alert the person that they are nearing the end of the sleep surface. Side rails are also useful as an assist device or grab bar for stability and for making adjustments in positioning. Of course, there have been many improvements over the years. Some examples include:

U.S. Pat. No. (hereafter, "USPN") 3,585,659 to Burst et al. is titled Safety Side Guard for Hospital Beds. It describes a generally rectangular safety side guard pivotally mounted upon the mattress frame of a hospital bed and movable around the pivotal mountings from an elevated guarding position to a lowered inoperative position. Stops are provided to limit movement of the guard into the positions and latch means are provided to secure the guard in an elevated position.

U.S. Pat. No. 4,747,171 to Einsele et al. is titled Hospital Bed Rail Assembly. This patent shows a hospital bed having a storable safety rail. The bed includes a frame having a pair of laterally extending slide tubes mounted thereto. A pair of mounting shafts are positioned within the tubes and secure the safety rail to the frame. A stop member is positioned near the inner end of at least one of the tubes. The mounting shaft includes a projection which abuts the stop member when in a first rotational position, but is able to pass thereby when in a second rotational position. The stop member preferably includes an inclined surface opposing the inner end of the slide tube to urge the projection, and therefore the rail, outwardly as the mounting shafts rotate to move the rail to the raised position. A retraction spring is provided for urging the safety rail towards the bed frame while in the lowered position. The safety rail also includes a brake mechanism to resist the gravitational forces urging it downwardly from the raised position.

U.S. Pat. No. 6,389,622 to Her et al. is titled Hospital Bed. It describes a bed frame having a bed frame, a bed platform, a front plate, a distal plate, and two separate siderails at each side. The bed platform is structured by plurality of plates made by injecting plastics from a mold and serving to enhance the structure. The elevation angle of the bed platform can be adjusted by a driving device. Each of the siderails can be lifted or descended so that the patient can get on or off the bed conveniently. The outer side of each siderail is installed with at least one inner concave groove for fingers insertion when pull or push the siderails for safely purpose. Inner side of one siderail is installed with a motor controller to drive the driving device. The design will prevent the event of losing or destroying since it is fixed at a proper place. Besides, lower corners of the front and distal plates are installed with an impact-proof head to prevent the patient or others from being harmed by the corners. In particular, movable clamping pieces comprising a fixing seat, a pressing plate, a movable rear clamping plate, and a tightening block, are preset to the front plate and distal plate. With the special connection of the movable clamping pieces, the front plate and distal plate can be assembled or detached conveniently and easily.

U.S. Pat. No. 7,591,034 to Kramer et al. is titled Apparatus and Method for Closing Hospital Bed Gaps. It shows a patient support including a frame, a mattress supported by the frame, and a set of siderails configured to block egress of a patient from the patient support. The siderails are configured to reduce gaps defined between the siderails and the other components of the patient support.

While each of these examples show devices that may work well for their intended purposes, none show a biasing mechanism useful to bias the siderail towards either the up or down position.

Further, none teach that going over center can increase the horizontal movement of the side rail in proportion to a net change in vertical position.

Still further, none show the use of hard stops in the up position to provide a strong structure to prevent failure.

Still further, none show a release lever that acts in addition to a fixed stop in an up position.

Thus there exists a need for a side rail that solves these and other problems.

SUMMARY OF THE INVENTION

According to one embodiment of the present invention, a side rail is provided having a body selectably movable from a first up position to a second down position. Two parallel lever arms are also provided. The arms rotate over center when moving the body between the two positions. This increases the horizontal distance through which the side rail moves. A biasing mechanism can be provided to urge the side rail towards either the up or down position, and to bias away from an intermediate toggle position wherein the lever arms are vertical in a preferred embodiment. The biasing mechanism can include a cam and roller. A hard stop can be provided, whereby in the up position there is a strong component to prevent failure. A release lever is also provided. A person can actuate the release lever to move the side rail from the up position.

According to one advantage of the present invention, a biasing mechanism useful to bias the siderail towards either the up or down position is provided. The biasing mechanism in one embodiment can be a cam and roller.

According to another advantage of the present invention, the horizontal movement of the side rail in proportion to a change in vertical position is increased by the defined lever arm path which swings over center. This advantageously allows the side rail to be positioned remote from the head board in the up position to allow for increased performance, yet allows the side rail to be unobtrusively stored when in the down position.

According to a still further advantage of the present invention, a hard stop is provided in the up position to provide a strong structure to prevent failure of the side arm. A hard stop can also be provided in the down position.

According to a still further advantage of the present invention, a release lever that acts in addition to a fixed stop in an up position is provided. In this regard, the release lever must be actuated before the side rail can be moved from the up position.

Other advantages, benefits, and features of the present invention will become apparent to those skilled in the art upon reading the detailed description of the invention and studying the drawings.

DETAILED DESCRIPTION OF THE PREFERRED EMBODIMENTS

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Figure 1:
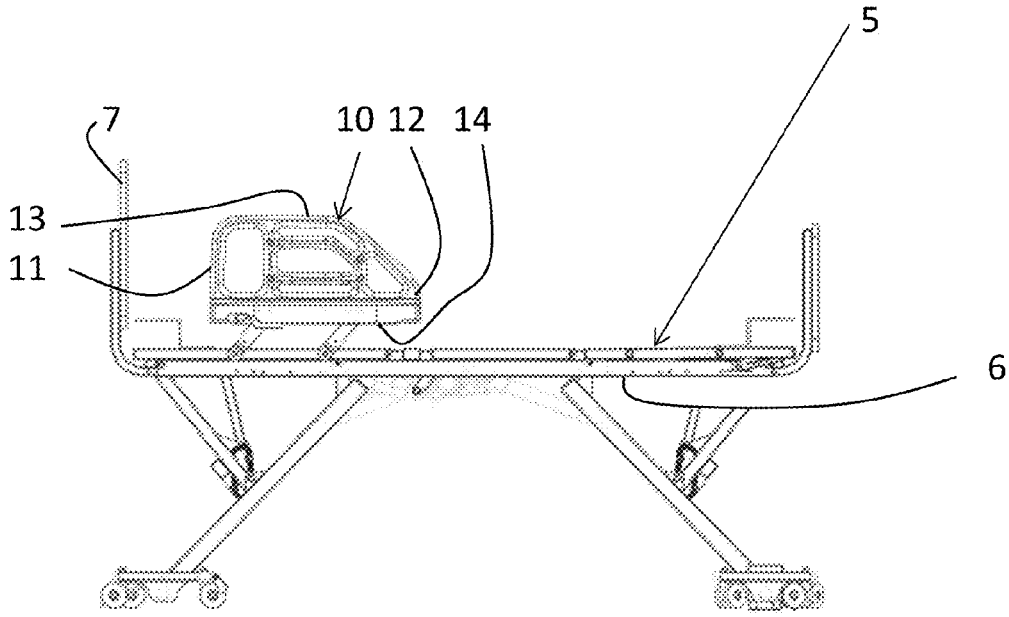
FIG. 1 is a side view of a preferred embodiment of the present invention in an up position.
Figure 2:
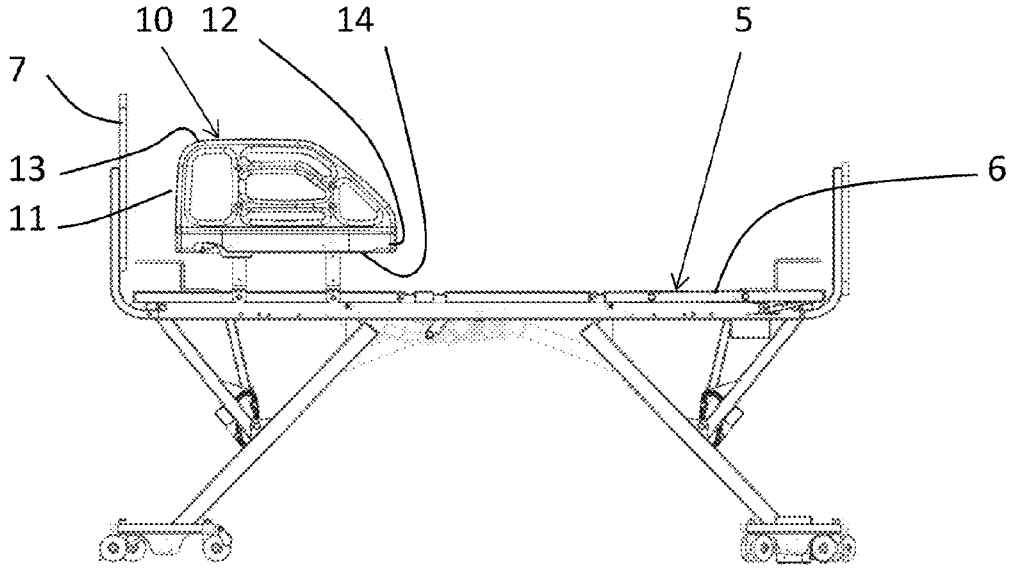
FIG. 2 is a side view similar to FIG. 1, but showing the embodiment in a toggle position.
Figure 3:
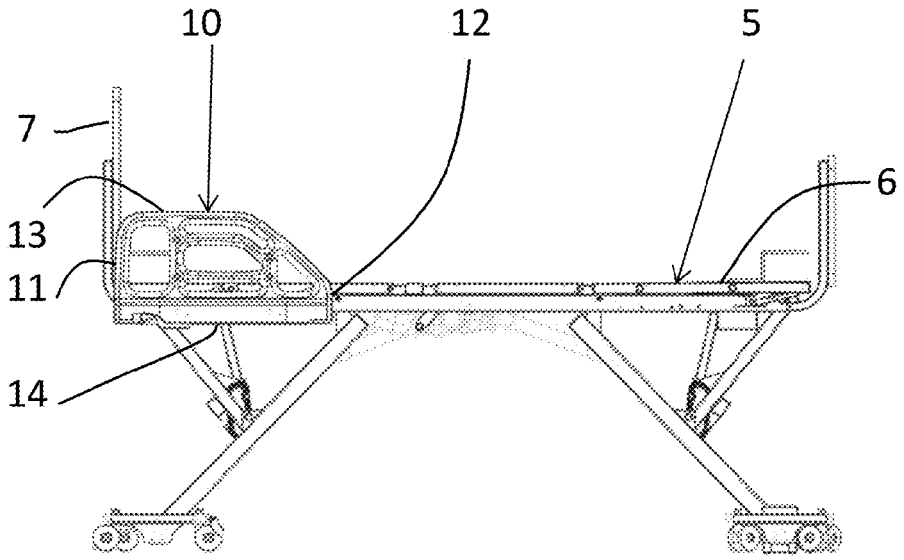
FIG. 3 is a side view similar to FIG. 1, but showing the embodiment in a down position.
Figure 4:
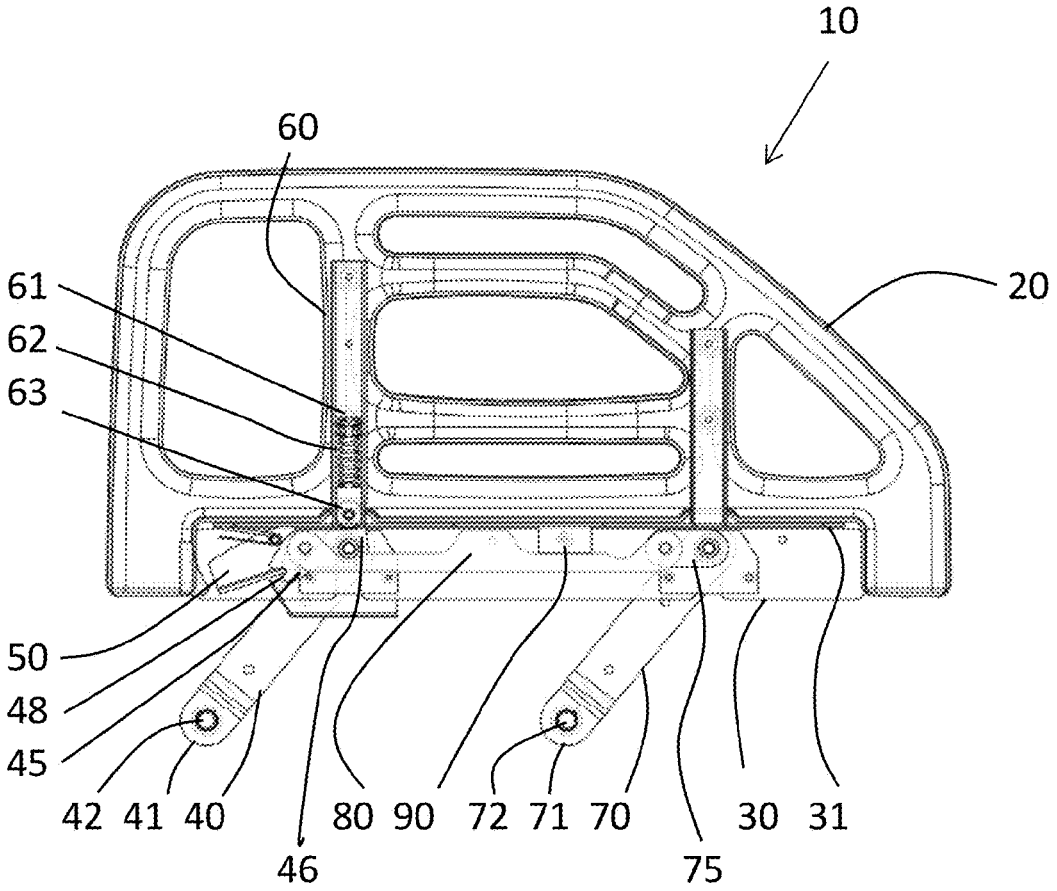
FIG. 4 is a cross-sectional view showing a preferred embodiment in the up position.
Figure 5:
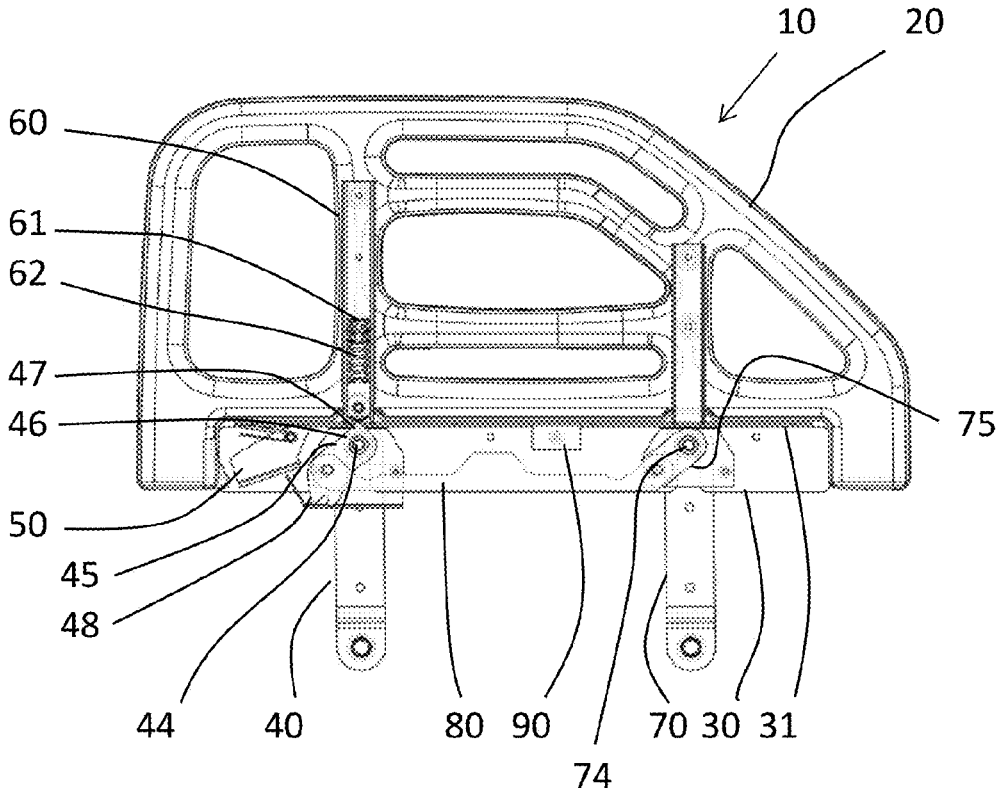
FIG. 5 is a cross-sectional view showing a preferred embodiment in the toggle position.
Figure 6:
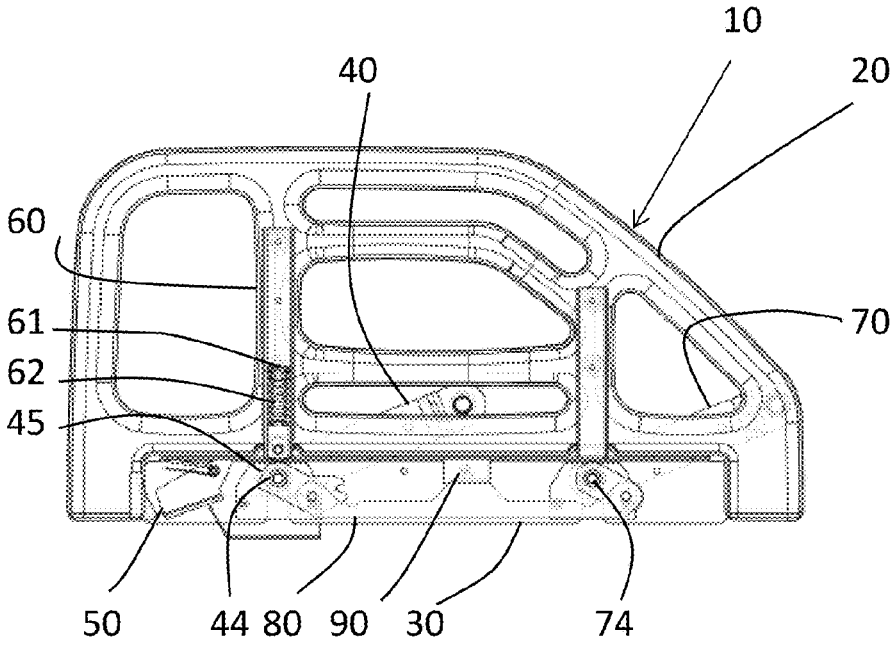
FIG. 6 is a cross-sectional view showing a preferred embodiment in the down position.

Looking first at FIGS. 1-3, it is seen that a bed 5 with a deck 6 and a headboard 7 is provided. The specific structures of the bed and deck are not of particular importance to the present invention. It is, however, contemplated that the present invention is useful for many styles of beds including but not limited to Hi-Lo style beds.

A side rail 10 is removably connected to the deck 6 of the bed near the headboard 7. The side rail 10 has a first end 11, a second end 12, a top 13 and a bottom 14. The first end is the end that is closest to the headboard 7.

In FIG. 1, the side rail 10 is shown in an up position. In FIG. 2, the side rail 10 is shown in a toggle position (described below). In FIG. 3, the side rail 10 is shown in the down position. In the up position, it is seen that the side rail 10 is sufficiently far from the headboard 7 whereby there is not an entrapment issue. In the low position, the side rail 10 is sufficiently close to the headboard whereby there is not an entrapment issue. This is accomplished as described below.

In one embodiment where a 76 inch bed is used, the distance between the headboard face and the first end 11 of the rail 10 is 9.5 inches in the up position, 5.5 inches in the toggle position, −1.0 inches in the near down position (block engaged) and −0.5 inches in the full down position (hard stop engaged). In this regard, it is appreciated that the side rail end 11 can pass beyond the face of the headboard during its swing to the down position in order to be unobtrusive.

In the down position, a person can be removed from the bed 5, as the top 13 of the side rail 10 is approximately the same height as the height of a mattress (not shown). The side rail 10 can also be removed from the bed 5 to facilitate moving a person from the bed 5.

Figure 7:
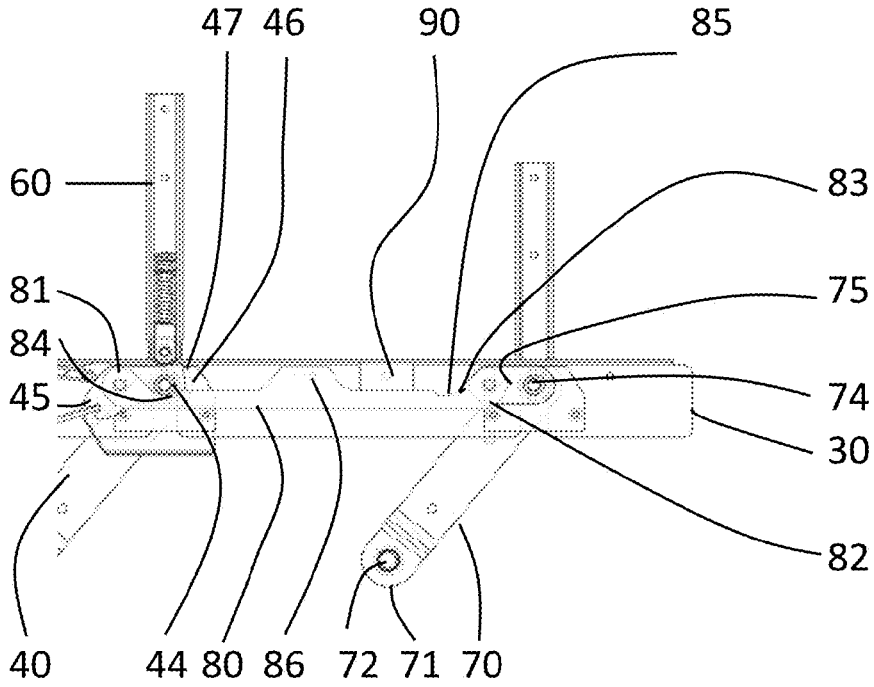
FIG. 7 is a cross-sectional view showing selected components of a preferred embodiment in the up position.
Figure 8:
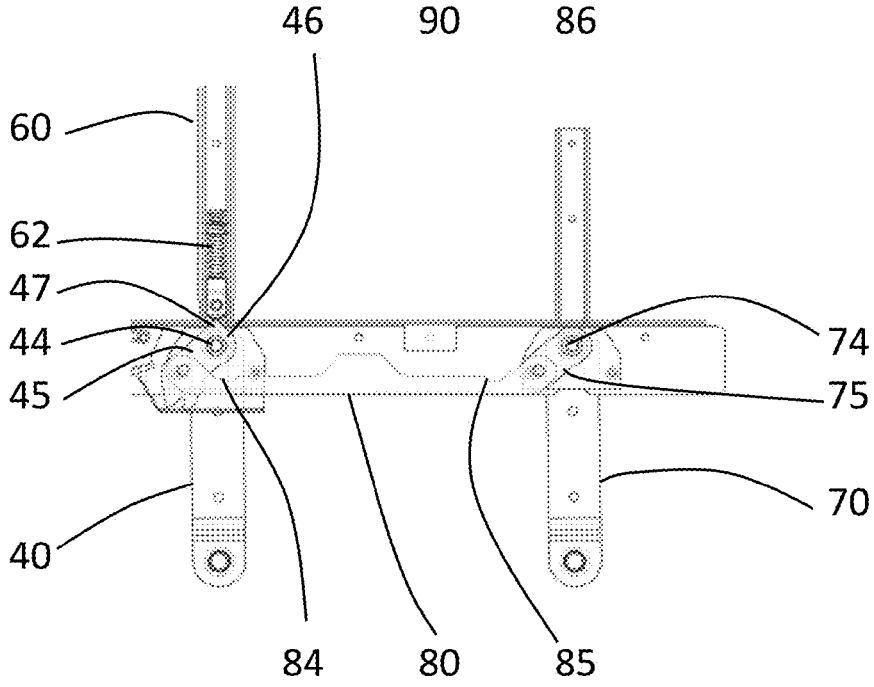
FIG. 8 is a cross-sectional view showing selected components of a preferred embodiment in the toggle position.
Figure 9:
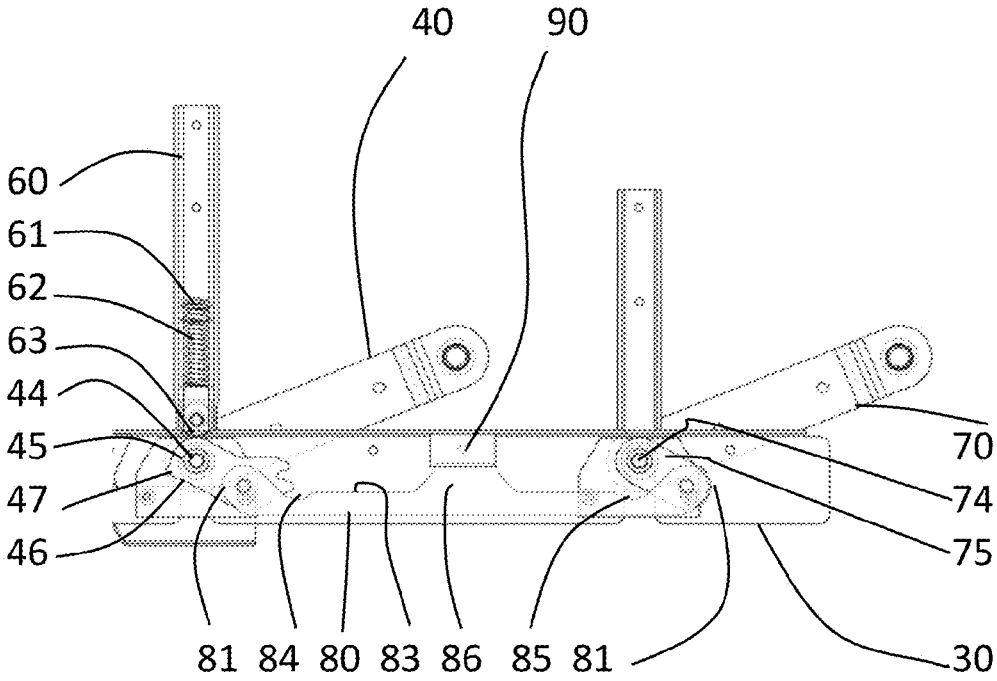
FIG. 9 is a cross-sectional view showing selected components of a preferred embodiment in the down position.

Turning now to FIGS. 4-9, it is seen that the components of the side rail 10 are illustrated in several cross-sectional views (FIGS. 4-6) and in the several isolation cross-sectional views (FIGS. 7-9).

A body 20 is provided. The body can be a molded body made of plastic. Alternatively, it can be formed from other materials without departing from the broad aspects of the present invention. The body has an opening at the bottom, whereby an insert 30 with a housing 31 is received. The insert 30 can be made of metal or other materials. The insert aids in holding, maintaining and/or aligning many of the other components.

A first lever arm 40 is provided. The lever arm 40 has a first end 41 and a second end 43. A pin 42 is at or near the first end 41. A pin 44 is at or near the second end 43. A plate 45 can be fixed relative the first lever arm 40. The plate 45 can define a cam 46 having a peak 47 at one end. An ear is preferably at the second end of the plate.

A release 50 (or release lever) is also provided. The release lever removably engages with the ear 48 of the plate 45. While shown to engage the ear 48 of the plate 45, it is appreciated that the release could alternatively engage other portions of the side rail 10 without departing from the broad aspects of the present invention.

A cylinder 60 is received within the body 20. The cylinder 60 can house a stop 61 and a spring 62. The stop engages or acts against a first end of the spring. A roller 63 can act against a second end of the spring 62. The spring biases the roller 63 away from the stop 61. The roller 63 moves closer to the stop 61 under compression of the spring 62.

It is appreciated that the cam of the lever arm 40 and the roller 63 and spring 62 form a biasing assembly. In this regard, the peak 47 of the cam 46 acting against the roller 63 defines the toggle point. In this regard, the biasing mechanism is useful to bias or urge the side rail 10 to move away from the toggle point. It is further appreciated that while one embodiment of a biasing mechanism is illustrated, that other embodiments may be used (including but not limited to having the components be in reverse order) without departing from the broad aspects of the present invention.

A second lever arm 70 is also illustrated. The lever arm 70 has a first end 71 and a second end 73. A pin 72 can be at or near the first end 71. A pin 74 can be at or near the second end 73. A link plate 75 is further provided and is preferably fixed with respect to the second lever arm 70.

Pins 44 and 74 are useful to connect the side rail 10 to the deck 6. The pins can be received within respective holes. Lanyards or other structures can be used to secure the pins 44 and 74 in place. Each pin 44 and 74 defines an axis of rotation, and the side rail swings or orbits about each respective axis or rotation A link 80 is still further provided. The link 80 has opposed ends 81 and 82. A top edge 83 is also provided. A first cutout 84 or relief is formed along the top 83 of the link near the first end 81. A second cutout 85 or relief is formed along the top of the link near the second end 82. A tab 86 projects upward from the top 83 of the link. The link 80 connects or links the first lever arm 40 and the second lever arm 70. Specifically, the link is pivotally connected to both the plate 45 of the first lever arm 40 and the link plate 75 of the second lever arm 70. The link swings an offset distance from pins 42 and 72. The link 80 is preferably contained within the housing 31. The link plate maintains the parallel orientation of the lever arms 40 and 70 enabling them to act in tandem. It is also appreciated that since the link 80 maintains a parallel orientation of the levers 40 and 70, that only a single biasing mechanism can be used.

An absorption member, such as a compressible block 90 is further provided. The absorption member can absorb energy to slow or soften an impact. The block can be a compressible block, made of rubber or a similar material. However, the block 90 can be made of other materials without departing from the broad aspects of the present invention. For example, a spring can be used without departing from the broad aspects of the present invention. Also, it is envisioned that a dampening member that works in a manner other than compression may be used without departing from the broad aspects of the present invention. In the preferred embodiment, the absorption member progressively compresses as additional loading is applied to it.

Looking now at FIGS. 7-12, a detailed illustration of each of the positions about a preferred orbital path is provided. It is appreciated that the lever arms 40 and 70 cause the body 20 to orbit about a path relative the respective lever arms ends that are pivotally connected to the bed 5.

Figure 10:
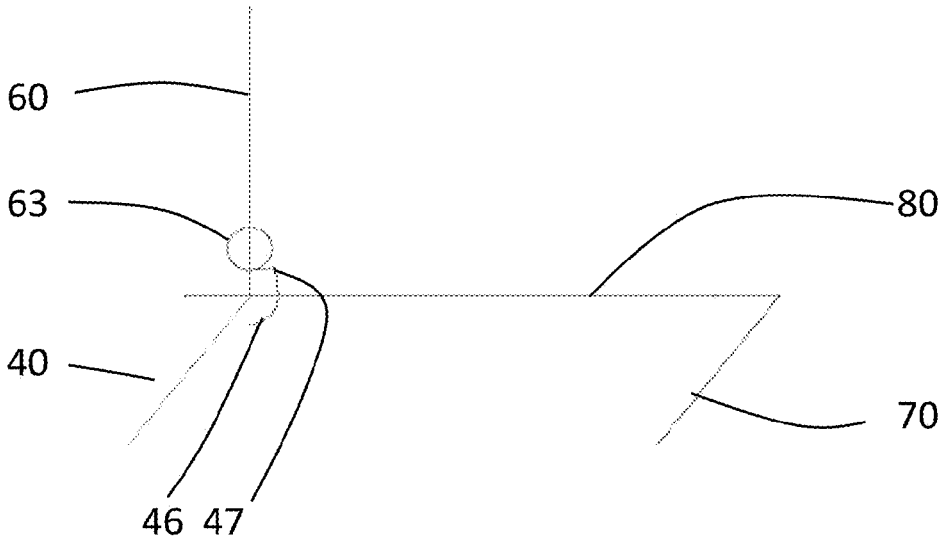
FIG. 10 is a schematic view of a preferred embodiment in the up position.

Specifically in FIGS. 7 and 10, the present invention is shown in the up position. It is understood that the up position is not the tallest position, as the body goes over center at the highest position in moving from the down position to the up position. To move from the up position, the body first moves vertically upwards (at least has a vertical component to the travel) towards the highest position.

In the up position, the peak 47 of the cam 46 is on the first side of the roller 63. Also, the pin 44 engages the cutout 84 of the link 80. This is a hard stop that prevents further rotational movement of the side rail. It is also seen that the block 80 engages the top edge 83 of the link. The release 50 engages the ear 48 of the link plate when the side rail 10 is placed in the up position. The lever can be released (for example by pivoting a release arm) to disengage the release 50 from the ear 48 of the plate 45 whereby the operator can move the side rail 10. In the preferred embodiment, the up position occurs when the lever arms 40 and 70 are approximately 38.5 degrees beyond vertical. However, it is appreciated that the arms could be at other locations without departing from the broad aspects of the present invention.

Figure 11:
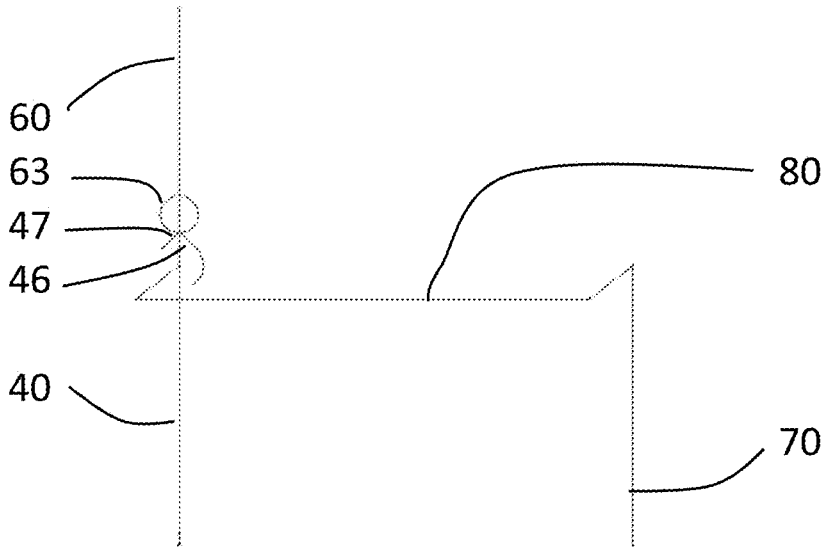
FIG. 11 is a schematic view of a preferred embodiment in the toggle position.

Looking now specifically at FIGS. 8 and 11, it is seen that the present invention is shown in the toggle position. On each side of the toggle position, the side rail is biased towards being in the up position or the down position. The toggle position occurs when the peak 47 of the cam 46 engages the roller 63 to force maximum compression of spring 62. In the preferred embodiment, this occurs when the lever arms are oriented generally vertically. However, it is understood that the toggle point could occur at other angular orientations as well without departing from the broad aspects of the present invention.

The biasing mechanism can apply a force from the toggle point throughout the entire swing to the up position. Alternatively, the biasing mechanism can apply a force for only a portion of the swing beyond when the lever arms are vertically oriented.

Likewise, the biasing mechanism can apply a force from the toggle point throughout the entire swing to the down position. Alternatively, the biasing mechanism can apply a force for only a portion of the swing beyond when the lever arms are vertically oriented.

In all, in the preferred embodiment, the biasing mechanism can apply a force upon the side rail through approximately a 77 degree range. However, this range can be enlarged or reduced, and can even be applied to different rotational degrees upon each side of the toggle point without departing from the broad aspects of the present invention. It is preferred that the biasing mechanism apply a force a sufficient angular distance until it is highly likely that gravity alone will move the side rail to either the up or down position.

Figure 12:
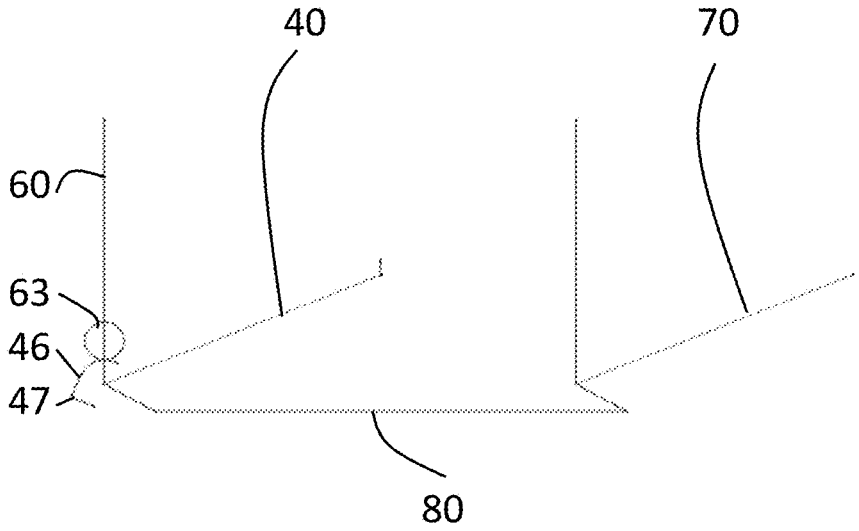
FIG. 12 is a schematic view of a preferred embodiment in the down position.

Looking now specifically at FIGS. 9 and 12, it is seen that the present invention is shown in a down position. In the down position, the peak 47 of the cam 46 is on the second side of the roller 63. The block 90 first engages the tab 86 of the link 80. Since the block is compressible, it softens the stopping of the side rail as it swings to the low or down position. Pin 74 can engage cutout 85 of the link 80 to form a hard stop (if the absorption member is compressed far enough), which prevents further rotational movement of the side rail 10. It is further appreciated that the block can contact anywhere on the link (even if the link does not have a tab) without departing from the broad aspects of the present invention.

It is appreciated that while several hard stop embodiments are illustrated, that other structures could be used without departing from the broad aspects of the present invention.

Thus it is apparent that there has been provided, in accordance with the invention, a height adjustable apparatus that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A side rail for use with a bed having a deck, said side rail comprising:

a body movable between a first position and a second position, said body moving through a path with a toggle point between the first position on a first side of said toggle point and the second position on a second side of said toggle point;

a biasing mechanism to move said body away from said toggle point to said first position when said side rail is on said first side of said toggle point and to said second position when said side rail is on said second side of said toggle point, said biasing mechanism comprising a spring and a stop located within the body, said stop being a fixed point upon which said spring is compressible against to provide a biasing force away from said stop.

2. The side rail of claim 1 further comprising a lever arm, said body being connected to said lever arm to define the path through which said body travels between said first position and said second position.

3. The side rail of claim 2 wherein said biasing mechanism is operable with said lever arm.

4. The side rail of claim 3 wherein said biasing mechanism comprises:

a cam; and a roller.

5. The side rail of claim 4 wherein said roller is within said lever arm.

6. The side rail of claim 2 wherein said lever arm is a first lever arm, and said side rail further comprises:

a second lever arm; and a link, wherein said link causes said first lever arm and said second lever arm to act in tandem.

7. The side rail of claim 6 wherein said link has a cutout and said first lever arm has a pin, said pin of said first lever arm contacting said link at said cutout when said body is in the second position to act as a hard stop preventing further motion of said body relative said link.

8. The side rail of claim 7 further comprising:

a housing, said link being movable within said housing; and absorption member fixed relative said housing;

wherein:

said absorption member contacts said tab when said body is in the first position.

9. The side rail of claim 8 wherein:

said link has a top spanning longitudinally between a link first end and a link second end; and said tab is located on said link top between said link first end and said link second end.

10. A side rail for use with a bed having a deck, said side rail comprising:

a body movable between a down position and an up position, said body moving through a path with a highest point and a toggle point at the highest point between the up position and the down position, wherein movement from said up position to said down position is orbital and comprises a first upwardly vertical portion;

a first lever arm supporting said body, said first lever arm having a first lever arm pin;

a second lever arm supporting said body;

a link connecting said first lever arm and said second lever arm, said link having a link top and a link cutout formed in said link top, said first lever arm pin contacting said link cutout forming a hard stop preventing said body from further rotation relative to said link when said body is in the up position; and a release, said release holding said body in the up position to prevent movement of said body in said first upwardly vertical portion until a manual release of said release, wherein said first lever arm pin ceases contact with said link cutout when said body moves in said first upwardly vertical portion.

11. The side rail of claim 10 further comprising a biasing mechanism, said biasing mechanism moving said body away from said toggle point to either of said up position or said down position.

12. The side rail of claim 11 wherein said biasing mechanism comprises:

a cam on a cam plate; and a roller.

13. The side rail of claim 12 wherein said release engages said cam plate when said body is in said up position.

14. The side rail of claim 10 further comprising an absorption member, said absorption member being connected to a tab projecting up from said top of said link, said absorption member contacting said tab when said body is in said down position to soften the stopping of said side rail as it moves to said down position.

15. A side rail for use with a bed having a deck, said side rail comprising:

a body movable between a down position and an up position, said body moving through a path with a highest point and a toggle point at the highest point between the up position and the down position;

a first lever arm supporting said body, said first lever arm having a first lever arm pin;

a second lever arm supporting said body;

a link connecting said first lever arm and said second lever arm, said link having a link first end, a link second end and a link top, said link top further having a cutout formed therein; and an absorption member, wherein:

said first lever arm pin contacts said cutout when said body is in the up position to act as a hard stop to prevent further rotation of said body relative to said link;

said absorption member contacts said link top when said body is in the down position softly stopping rotation of said side rail;

said link top comprises a tab; and said absorption member contacts said tab when said body is in the down position.

16. The side rail of claim 15 further comprising a biasing mechanism, said biasing mechanism moving said body away from said toggle point to either of said up position or said down position.

17. The side rail of claim 16 wherein said biasing mechanism comprises:

a cam on a cam plate; and a roller.

18. The side rail of claim 17 further comprising a release, wherein said release engages said cam plate when said body is in said up position.

19. The side rail of claim 1 wherein there is a highest point between the first position and the second position and said toggle point is at said highest point.

* * * * *